United States Patent [19]

Little et al.

[11] Patent Number: 4,869,187

[45] Date of Patent: Sep. 26, 1989

[54] SEWING MACHINE HAVING SEWING FORCES MEASUREMENT SYSTEM

[75] Inventors: Trevor J. Little; B. Ann Matthews, both of Raleigh, N.C.

[73] Assignee: North Carolina State University, Raleigh, N.C.

[21] Appl. No.: 212,912

[22] Filed: Jun. 29, 1988

[51] Int. Cl.[4] ..... D05B 81/00

[52] U.S. Cl. ..... 112/262.1; 112/235; 112/270; 112/121.11; 73/862.54

[58] Field of Search ..... 112/270, 235, 272, 121.11, 112/262.1, 453; 73/862.54, 862.55, 862.65

[56] References Cited

U.S. PATENT DOCUMENTS

| | | | |
|---|---|---|---|
| 3,055,326 | 9/1962 | Greulich | 112/235 |
| 3,554,025 | 1/1971 | Andersson et al. | 73/141 |
| 4,166,423 | 9/1979 | Brienza et al. | 112/254 |
| 4,343,249 | 8/1982 | Takenoya et al. | 112/453 X |
| 4,363,281 | 12/1982 | Reinke | 112/121.11 |
| 4,478,092 | 10/1984 | Oren, III | 73/862.55 |
| 4,565,140 | 1/1986 | Martell et al. | 112/121.11 |
| 4,565,143 | 1/1986 | Hanyu et al. | 112/262.1 |
| 4,660,481 | 4/1987 | Spickermann | 112/235 |
| 4,798,152 | 1/1989 | Simons et al. | 112/262.1 |

FOREIGN PATENT DOCUMENTS

| | | | |
|---|---|---|---|
| 3540126 | 2/1987 | Fed. Rep. of Germany | 112/121.11 |
| 1064279 | 4/1986 | Japan | 112/235 |
| 2120883 | 6/1987 | Japan | 112/235 |

*Primary Examiner*—Peter Nerbun
*Attorney, Agent, or Firm*—Richard E. Jenkins

[57] ABSTRACT

A sewing machine having a presser bar and a needle bar and each having a force transducer mounted thereon for simultaneously detecting changes in load applied to the presser bar and needle bar. The force transducers are connected to a circuit including a computer for monitoring the fabric feeding and stitch formation forces encountered by the presser bar and the needle bar during sewing and analyzing the simultaneous force signal data from the force transducers on the needle bar and the presser bar of the sewing machine.

20 Claims, 4 Drawing Sheets

SEWING MACHINE HAVING SEWING FORCES MEASUREMENT SYSTEM

TECHNICAL FIELD

The present invention relates in general to high speed sewing machines and in particular to a new and useful sewing machine having a system for simultaneously monitoring and analyzing forces exerted on the presser bar and needle bar during the sewing process.

BACKGROUND ART

In the last two decades of research on high speed sewing a much greater understanding of the complex interactions involved in joining two or more plies of material with thread has been achieved. It should be appreciated that although almost 150 years has now passed since the invention of the sewing machine, rigorous scientific analysis of the operation thereof did not begin until sewing machine speeds increased beyond about 3000 stitches per minute. At this sewing speed, the number of problems related to sewability increases due both to the higher speeds and the newer types of textile materials being joined together. More specifically, finer gauge knitted fabrics, fabrics processed with new dyes and finishes, and the widespread acceptance of synthetic fibers in both fabrics and sewing threads creates new sewability problems, particularly at the new high sewing speeds in excess of 3000 stitches per minute.

Researchers have previously investigated the aforementioned high speed sewing problems with a wide range of testing instruments and recommended a number of ways to minimize the problems. However, as the apparel industry becomes ever more automated, the sewing machine will be subjected to new manufacturing requirements since the operator thereof will no longer have direct control of the material being sewn in the machine. In future apparel manufacturing environments the sewing machine will be required to be more flexible in order to perform equally efficiently in processing a wide range of materials.

A substantial proportion, if not the majority, of previous material sewability testing has been conducting utilizing a strain gauge secured to the underside of the throat plate of a sewing machine. This type of testing system generally provides comparative needle penetration force data, but a clarity of force data is difficult to obtain since the throat plate is subjected to forces from the presser foot as well as needle penetration forces. Efforts have been made in the past to minimize presser foot force influences by using an alternative feeding mechanism, but when this technique is used the practical value of data obtained is severely limited due to the modification of the sewing system being studied.

Also, other researchers in attempting to test sewability and obtain an understanding of the forces relating thereto have failed to provide good resolution of forces at high sewing speeds. As is known to those skilled in this art, the prior testers' results tended to lose clarity of force resolution at about 2000 stitches per minute. Thus, testers have continued the search for a better understanding of the forces involved in high speed sewing of materials and the development of equipment to measure these forces.

DISCLOSURE OF THE INVENTION

In accordance with the present invention, applicant provides a sewing machine having a system for measuring and analyzing the forces associated with needle and material interaction as well as forces associated with the material feeding system. The system accomplishes this objective by independently detecting and analyzing the forces encountered by the needle bar and the presser bar of a high speed sewing machine which correspond to forces created by needle penetration and withdrawal and material advancement, respectively. With the measuring system of the instant invention, it is possible to accurately detect changing sewing parameters including variations in the material being sewn, increasing plies of material being sewn, the presence of thread in the needle, occurrence of stitch formation, frictional forces on the sewing needle and the operating dynamics of the material feeding system.

The sewing machine and force measurement system of the invention includes a high speed sewing machine having a suitable transducer secured to the presser bar for measuring forces applied to the presser bar during sewing and a suitable transducer secured to the needle bar for simultaneously measuring forces applied to the needle bar during sewing. An electrically connected circuit means serves to monitor and analyze the fabric feeding and stitch formation forces being encountered by the presser bar and the needle bar, respectively. The circuit means may comprise either a digital recording oscilloscope and suitable programmed personal computer or a microprocessor semiconductor chip. In this fashion the sewing machine and force measuring system of the present invention serves to detect and analyze forces directly encountered by the needle bar and presser bar of a high speed sewing machine in order to detect changing sewing parameters which could not accurately heretofore be detected.

It is therefore the object of the present invention to provide a sewing machine having a force measurement system which is capable of accurately detecting changing sewing parameters at high sewing speeds in order to facilitate the high speed processing of materials with variations as well as different materials.

Another object of the present invention to provide a sewing machine having a force measurement system which measures and analyzes forces applied to the presser bar and needle bar of the sewing machine during the sewing process.

A further object of the present invention is to provide a sewing machine having a force measurement system which provides for simultaneously determining and analyzing the forces associated with both stitch formation and material advancement.

Some of the objects of the invention having been stated, other objects will become evident as the description proceeds, when taken in connection with the accompanying drawings described below.

BEST MODE FOR CARRYING OUT THE INVENTION

Figure 1:
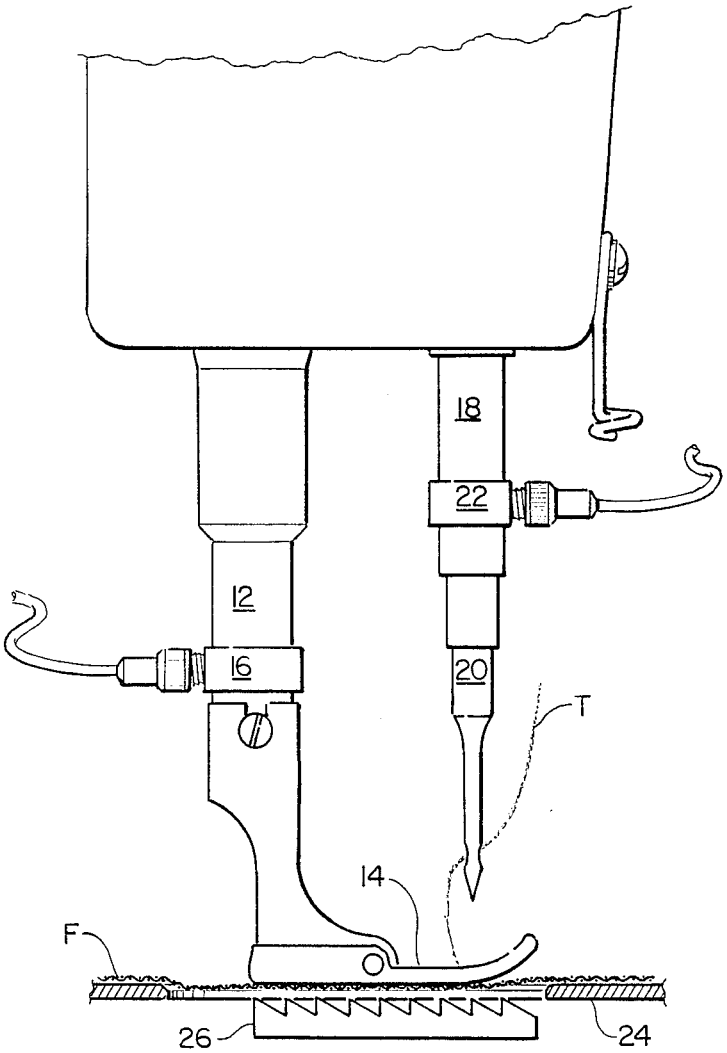
FIG. 1 is a side elevation view of the fabric feeding and stitch formation elements of the sewing machine and sewing forces measurement system of the present invention.
Figure 2:
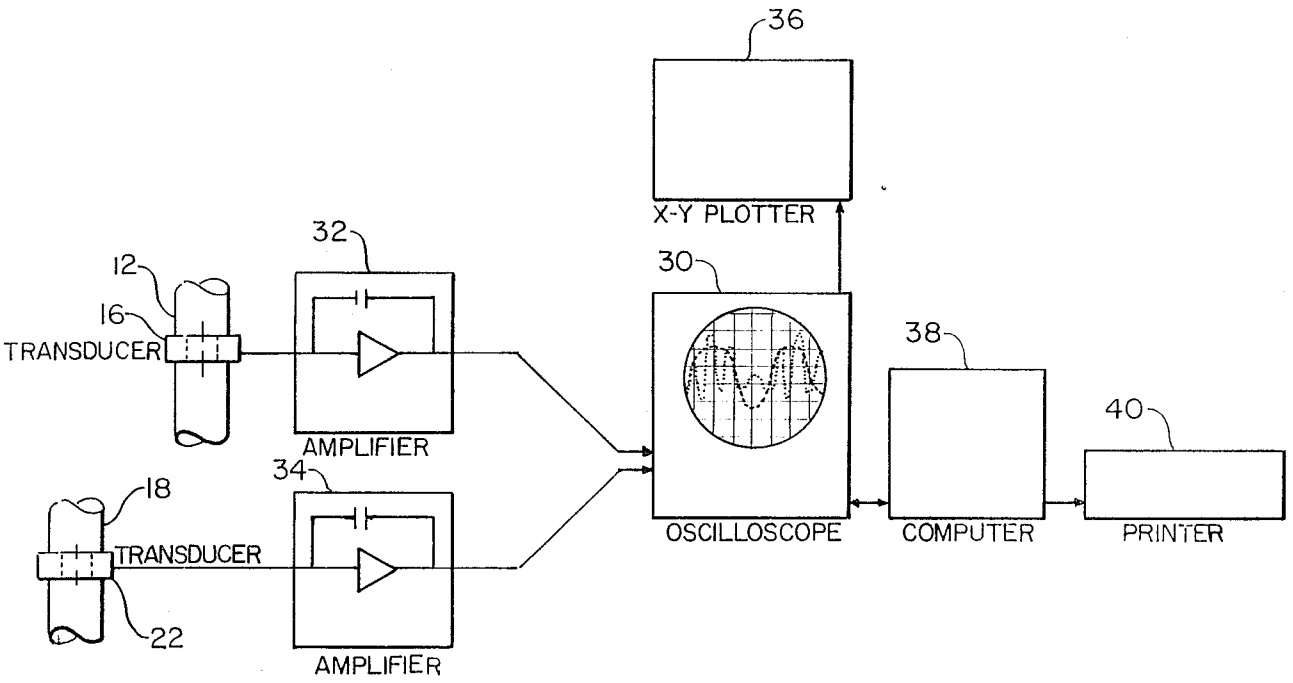
FIG. 2 is a schematic diagram of the sewing machine and sewing forces measurement system of the present invention.

Referring now more specifically to the drawings, a preferred embodiment of the sewing machine having a sewing forces measurement system according to the present invention is best seen with reference to FIGS. 1 and 2. The invention comprises a sewing machine with a presser bar 12 carrying a presser foot 14 at the bottom end thereof. A force transducer 16, most suitably a quartz load washer, is mounted on presser bar 12 for detecting forces applied to presser bar 12 during sewing. Needle bar 18 carries needle 20 at the lower end thereof and is also provided with force transducer 22 mounted to the shaft thereof for detecting forces applied to the needle bar during sewing. Thread T in needle 20 and a conventional throat plate 24 and feed dog 26 are also illustrated in FIG. 1. Although other sewing machines are clearly contemplated by the present invention, the preferred embodiment of the present invention utilizes a PFAFF Model 483 lock stitch sewing machine.

Force transducers 16 and 22 are most suitably Kistler Type 9001 quartz load washers (or piezoelectric force transducers) which are mounted directly into the cut and machine leveled shafts of presser bar 12 and needle bar 18 to ensure uniform force distribution throughout the supporting surface. Piezoelectric force transducers 16 and 22 mounted to the shafts of presser bar 12 and needle bar 18, respectively, are electrically connected to a two-channel recording oscilloscope 30 in order to permit simultaneous recording of sewing forces measured by the piezoelectric force transducers. Two charge amplifiers 32, 34, most suitably KISTLER Model 5004 dual mode amplifiers, are used to amplify the signal from piezoelectric force transducers 16 and 22, respectively, to oscilloscope 30.

Although many different oscilloscopes may be used in the instant invention, oscilloscope 30 is most suitably a Nicolet Model 2090 digital oscilloscope with a disk recorder so as to allow for high resolution recording of data. The two channels of oscilloscope 30 facilitate simultaneous recording of signal data from piezoelectric force transducers 16 and 22. The memory of the Nicolet Model 2090 allows for the recording of 16 waveforms per computer diskette wherein each waveform represents the forces applied to either presser bar 12 or needle bar 18 during a single sewing cycle. For proper force signal data analysis, the waveforms recorded on oscilloscope 30 from piezoelectric force transducer 16 and piezoelectric force transducer 22 must be in phase on oscilloscope 30.

Oscilloscope 30 is provided with X-Y plotter 36 to plot the digital signal data in oscilloscope 30 in analog form. Also, computer 38, most suitably an IBM PC/XT computer, is electrically connected to oscilloscope 30 and on line therewith for data analysis. Computer 38 serves to analyze digital signal data from oscilloscope 30 according to a predetermined program and data therefrom may be printed on printer 40 connected thereto. In the preferred embodiment of the invention, a software package is used to interface with oscilloscope 30 to perform waveform manipulation for data analysis. The software is entitled Waveform Basic and is distributed by Blue Feather Software Corporation. This software provides for data transmission from oscilloscope 30 to computer 38 and from computer 38 to oscilloscope 30. Printer 40 is an Epson Model FX80 printer although any other compatible printer may be utilized for printing of force signal data in digital form. Also, suitable coaxial cables are utilized to connect the various components of the sewing machine and sewing forces measurement system of the present invention.

Figure 3A:
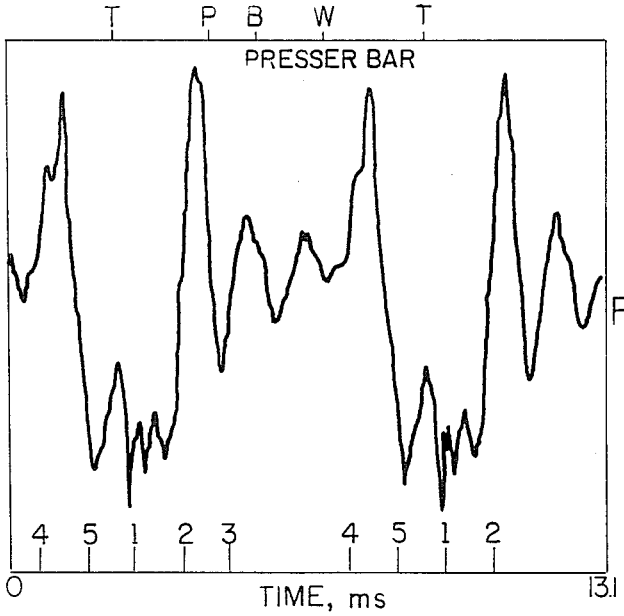
FIGS. 3A, and 3B depict a representative waveform of the presser bar forces and a corresponding waveform of the needle bar forces as measured during a sewing cycle.
Figure 3B:
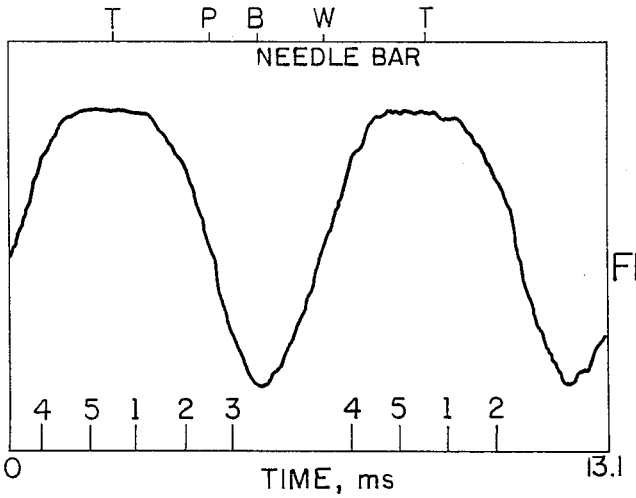
Figure 4:
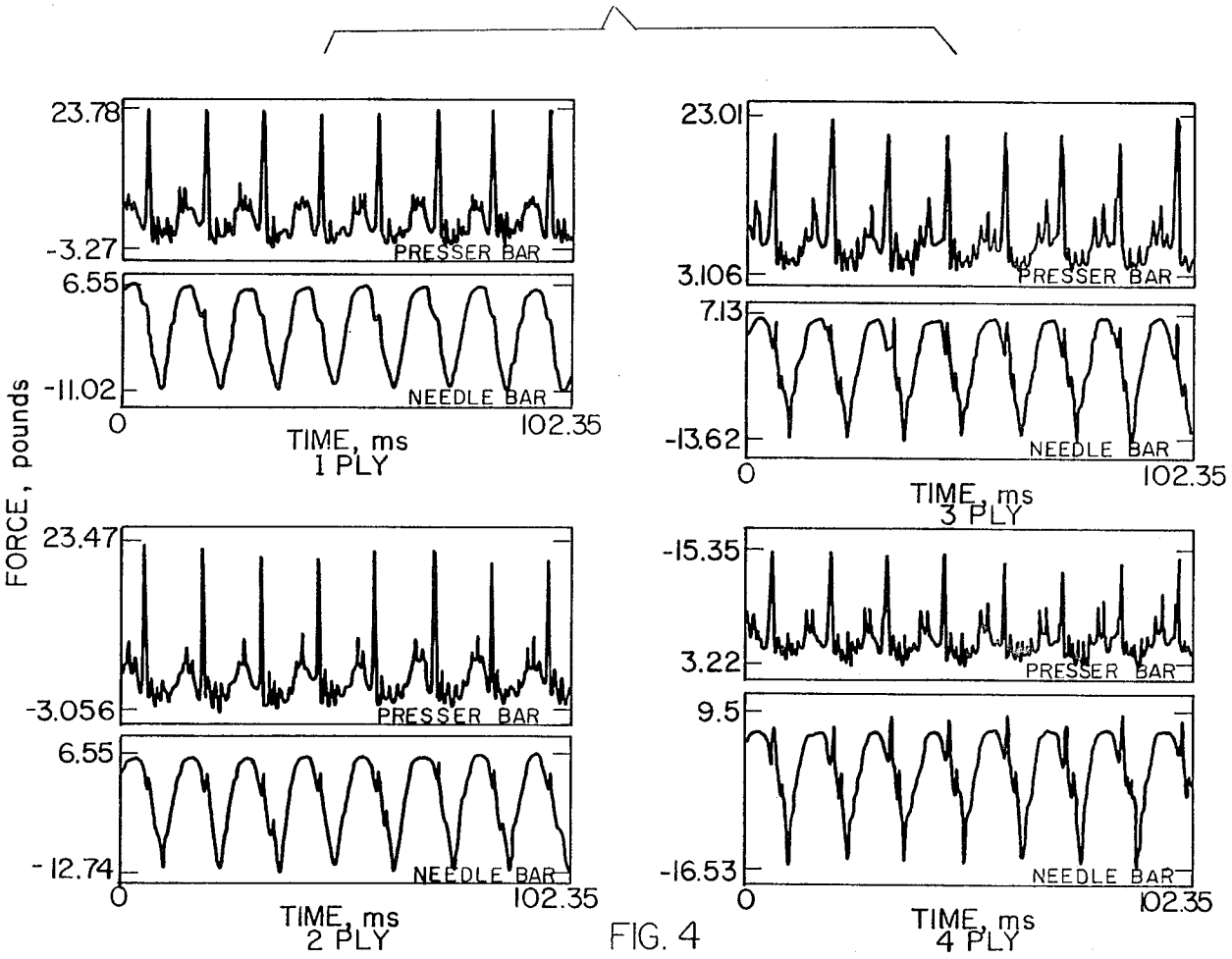
FIG. 4 depicts waveforms of the presser bar and needle bar forces encountered during several sewing cycles of one-ply, two-ply, three-ply and four-ply material.

Now that the elements of the system are known, the use thereof may be better understood with reference to FIGS. 3A, 3B and 4 of the drawings. With particular reference to FIGS. 3A, 3B, a representative graph is depicted showing a waveform representing the forces applied to the presser bar and a waveform representing the forces simultaneously applied to the needle bar during a sewing cycle of the sewing machine. With reference to the time line in FIG. 3A, it can be seen that a feeding cycle begins with the first numeral 4 wherein feed dog 26 is level with throat plate 24 and moving upward, and numeral 5 represents the portion of the feeding cycle wherein feed dog 26 is moving back and advancing fabric F. Moving successively along the time line of FIG. 3A, numerals 1 and 2 indicate where feed dog 26 begins its downward movement and drops below throat plate 24, and numeral 3 indicates the point of the feeding cycle where feed dog 26 is below throat plate 24 and moving forward. Numeral 4 is the beginning of another feeding cycle.

The stitching cycle represented by FIG. 3B can be seen in relation to the feeding cycle. Needle penetration occurs at point P on the time line (between point 2 and 3 in the feeding cycle), and the needle is withdrawn above throat plate 24 at point W. The top and bottom of the needle stroke is also indicated on the time line at points T and B, respectively. The forces simultaneously applied to presser bar 12 during a sewing cycle and needle bar 18 during the same sewing cycle can be clearly seen in the representative waveforms depicted in FIG. 3.

It should be appreciated that the force displacement waveforms taken simultaneously during a sewing cycle vary with processing parameters and thus much can be learned by a close study thereof. Also, although shown as two separate graphs in FIG. 3, the waveform representing forces applied to the presser bar and the waveform representing forces simultaneously applied to the needle bar are normally displayed simultaneously and in superimposed fashion on oscilloscope 30.

With reference now to FIG. 4, waveforms representing simultaneous force signal data from presser bar 16 and needle bar 22 for a plurality of sewing cycles of one-ply, two-ply, three-ply and four-ply of paper are depicted. As noted hereinbefore, differences in the waveforms are indicative of varying forces being applied simultaneously to the presser bar and needle bar of the sewing machine for different plies of paper. For these particular graphs, the sewing machine was operating at 4300 stitches per minute (SPM) on a paper material.

In operation, the sewing machine and forces measurement system of the present invention is used to evaluate the sewability of varying materials at high speeds. An analysis of the signal from needle bar 22 will indicate excessive forces which often result in fabric damage in the presence of thread in the needle, and it will also serve to distinguish differences in thread and needle sizes. The signal from the presser bar can distinguish and quantify the forces applied to fabric during the feeding and stitching cycles to facilitate proper stabilization and control of the material by the feeding system during sewing. Also, assuming a given needle size and presser foot design, material properties can be shown to influence the forces experienced during high speed sewing. Thus, for good sewability, it is necessary to stabilize the forces encountered by presser bar 12 and needle bar 18 after a full understanding of the sewing parameters has been established by testing which utilizes the sewing machine and forces measurement system of the present invention.

In addition to a pre-production evaluation of optimum sewing combination parameters the invention also contemplates that the analysis of sewability parameters can be utilized for the purpose of on-line evaluation of the sewability of fabrics. In particular, the occurrence of good seam formation can be evaluated on-line using the system of the present invention.

It will be understood that various details of the invention may be changed without departing from the scope of the invention. Furthermore, the foregoing description is for the purpose of illustration only, and not for the purpose of limitation—the invention being defined by the claims.

What is claimed is:

1. In a sewing machine having a presser bar on one end of which a presser foot is secured above a sewing station and a needle bar on one end of which a needle is secured for cooperatively engaging the sewing station, a force measuring system comprising:

first force measurement means mounted on said presser bar for measuring forces applied to the presser bar during sewing;

second force measurement means mounted on said needle bar for measuring forces applied to the needle bar during sewing; and circuit means electrically connected to said first and second force measurement means for monitoring fabric feeding and stitch formation forces encountered by the presser bar and the needle bar during sewing.

2. In a sewing machine according to claim 1 wherein said first and second force measurement means each comprise a force transducer.

3. In a sewing machine according to claim 2 wherein said force transducers are piezoelectric load washers.

4. In a sewing machine according to claim 1 wherein said circuit means comprises an oscilloscope electrically connected to said first and second force measurement means for displaying the forces encountered by the presser bar and needle bar during sewing.

5. In a sewing machine according to claim 4 wherein said oscilloscope is a recording digital oscilloscope providing for real time display of the waveform of presser bar forces and needle bar forces and digital recordation thereof.

6. In a sewing machine according to claim 4 wherein said circuit means includes an electrical amplifier in electrical connection between said first force measurement means and said oscilloscope and an electrical amplifier in electrical connection between said second force measurement means and said oscilloscope.

7. In a sewing machine according to claim 4 wherein said circuit means includes an X-Y plotter electrically connected to said oscilloscope.

8. In a sewing machine according to claim 4 wherein said circuit means includes a computer electrically connected to said oscilloscope for analyzing the force measured by said first and second force measurement means.

9. In a sewing machine according to claim 8 wherein said computer comprises a selectively programmed personal computer and an electrically connected printer.

10. In a sewing machine according to claim 1 wherein said circuit means comprises a microprocessor for monitoring and analyzing the forces measured by said first and second force measurement means.

11. In a sewing machine having a presser bar on one end of which a presser foot is secured above a sewing station and a needle bar on one end of which a needle is secured for cooperatively engaging the sewing station, a force measuring system comprising:

a transducer mounted on said presser bar for measuring forces applied to the presser bar during sewing;

a transducer mounted on said needle bar for measuring forces applied to the needle bar during sewing;

circuit means electrically connected to said first and second transducers for monitoring fabric feeding and stitch formation forces encountered by the presser bar and the needle bar during sewing; and computer means electrically connected to said circuit means for analyzing the forces measured by said first and second transducers.

12. In a sewing machine according to claim 11 wherein said computer means comprises a selectively programmed personal computer.

13. In a sewing machine according to claim 11 wherein said computer means comprises a microprocessor.

14. A method for simultaneously measuring the force being applied to the presser bar and to the needle bar of a sewing machine in order to analyze material stitching and feeding performance of the machine, said sewing machine being provided with a force transducer on both the needle bar and the presser bar and an electrically connected circuit means and computer means for monitoring and analyzing the forces encountered by the presser bar and needle bar, the method comprising the steps of:

simultaneously detecting the load changes applied to the presser bar and needle bar during operation of said sewing machine;

converting the detected load changes at the presser bar and needle bar into signal data representing the forces simultaneously applied to the presser bar and needle bar, respectively; and analyzing said signal data representing the forces simultaneously applied to the presser bar and needle bar of said sewing machine to determine certain material stitching and feeding performance parameters.

15. A method according to claim 14 wherein said force transducers serve to detect load changes and convert the detected load changes into signal data.

16. A method according to claim 15 wherein said force transducers comprise piezoelectric load washers.

17. A method according to claim 14 wherein the circuit means comprises an oscilloscope for monitoring said signal data and for simultaneously displaying a first waveform representing load changes applied to the presser bar and a second waveform representing load changes applied to the needle bar.

18. A method according to claim 17 wherein the circuit means includes a personal computer for analyzing said signal data.

19. A method according to claim 14 wherein the circuit means comprises a microprocessor for monitoring and analyzing said signal data.

20. A method for simultaneously measuring the force being applied to the presser bar and to the needle bar of a sewing machine in order to analyze material stitching and feeding performance of the machine, said sewing machine being provided with a force transducer on both the needle bar and the presser bar and an electrically connected oscilloscope and computer for monitoring and analyzing the forces encountered by the presser bar and needle bar, the method comprising the steps of:

simultaneously detecting the load changes applied to the presser bar and needle bar during operation of said sewing machine;

converting the detected load changes at the presser bar and needle bar into signal data representing the forces simultaneously applied to the presser bar and needle bar, respectively;

displaying said signal data in waveforms corresponding to forces applied to the presser bar and waveforms corresponding to forces applied to the needle bar; and analyzing said signal data representing the forces simultaneously applied to the presser bar and needle bar of said sewing machine to determine certain material stitching and feeding performance parameters.

* * * * *